US005678127A

United States Patent [19]

Suga

[11] Patent Number: 5,678,127

[45] Date of Patent: Oct. 14, 1997

[54] SHEET SUPPLY APPARATUS WITH CONTROL BASED ON DETECTED SHEET LENGTH

[75] Inventor: Takeshi Suga, Kawasaki, Japan

[73] Assignee: Canon Kabushiki Kaisha, Tokyo, Japan

[21] Appl. No.: 444,362

[22] Filed: May 18, 1995

[30] Foreign Application Priority Data

May 23, 1994 [JP] Japan ..... 6-132639

[51] Int. Cl.[6] ..... G03G 21/00

[52] U.S. Cl. ..... 399/45; 399/16; 399/208; 399/389

[58] Field of Search ..... 355/311, 235, 355/243

[56] References Cited

U.S. PATENT DOCUMENTS 4,260,248 4/1981 Murata et al. .

4,372,676 2/1983 Miyata et al. .

5,386,284 1/1995 Kasahara et al. ..... 355/311

FOREIGN PATENT DOCUMENTS 61-124447 6/1986 Japan .

*Primary Examiner*—R. L. Moses

*Attorney, Agent, or Firm*—Fitzpatrick, Cella, Harper & Scinto

[57] ABSTRACT

The present invention provides a sheet supply apparatus comprising a sheet supply device for supplying a sheet one by one from a sheet stack, a convey device for conveying the sheet supplied by the sheet supply device, a detection device for detecting a length of the sheet supplied by the sheet supply device, in a sheet supplying direction, a memory device, for storing the length of the sheet detected by the detection device, and a control device for operating the sheet supply device after the sheet is conveyed by the convey device, on the basis of information regarding the length of the sheet stored in the memory device.

28 Claims, 13 Drawing Sheets

| |
|---|
| FIG. 9A |
| FIG. 9B |

IMAGE SHRINK AREA UPON SHEET SUPPLY FROM SUPPLY PORTION 27

IMAGE SHRINK AREA UPON SHEET SUPPLY FROM SUPPLY PORTION 28

SHEET SUPPLY APPARATUS WITH CONTROL BASED ON DETECTED SHEET LENGTH

BACKGROUND OF THE INVENTION

1. Field of the Invention

The present invention relates to a sheet supply apparatus, and more particularly, it relates to a method for controlling a sheet supply apparatus used with an image forming apparatus such as a copying machine, a recording device and the like.

2. Related Background Art

FIG. 11 is a sectional view of a conventional copying machine (image forming apparatus). In FIG. 11, an original 129 rested on an original support glass plate 121 is scanned by shifting an optical device 122 having mirrors from a start position a to a return position b while illuminating light from an illumination device 123 onto the original. The scanned light image is formed on a photosensitive layer on a rotating drum 112 as a latent image through a lens 124, and the latent image is visualized as a toner image by a developing device 125. On the other hand, a sheet 101 is supplied from a sheet supply portion 127.

FIG. 12 is a side sectional view of the sheet supply portion 127. In FIG. 12, the sheet supply portion comprises a friction rotary member 102 rotatingly contacting with an uppermost sheet 101*a* of a sheet stack 101 contained in a cassette 100, and a pair of regist rollers 103, 104 disposed at a downstream side of the friction rotary member 102.

By rotating the friction rotary member 102, the sheet 101*a* is conveyed until a tip end of the sheet reaches a nip between the regist rollers 103, 104. Thereafter, by driving the regist rollers 103, 104 at a predetermined timing, the sheet 101*a* is further conveyed in a downstream direction. A convey speed of the sheet 101 obtained by the regist rollers 103, 104 is selected so as to be equal to a scanning speed of the optical device 122 during the copying operation.

The toner image is transferred onto the sheet 101 sent to a transfer portion 130 in synchronous with the drum 112 in this way. Then, the sheet is sent to a fixing device 126, where the toner image is permanently fixed to the sheet. Thereafter, the sheet is discharged onto a tray. In this way, a copy cycle is completed.

In the sheet supply portion 127, in order that the conveyance of the sheet 101*a* by the regist rollers 103, 104 is not obstructed by the friction rotary member 102 contacting with a rear end portion of the sheet 101*a*, a one-way clutch (not shown) is disposed in a drive transmitting system for the friction rotary member 102 to idly rotate the friction rotary member 102 as the sheet 101*a* is moved. In order to prevent the double-feed of the sheets, a separation pad 105 urged against the friction rotary member 102 is used so that the sheet is passed through a contact area between the friction rotary member 102 and the separation pad 105.

However, in the above-mentioned conventional technique, although the friction rotary member 102 is idly rotated while the sheet 101 is being conveyed by the regist rollers 103, 104, there is a danger of obstructing the conveyance of the sheet by the regist rollers 103, 104 due to friction resistance between the sheets and/or sliding resistance of the clutch. Particularly, in sheet supply apparatuses having a separation pad 105, since the separation pad 105 is not rotated and urged against the rotating friction rotary member 102 and the surface of the separation pad has a high coefficient of friction, the great force for preventing the movement of the sheet is generated by the separation pad, resulting in a problem that the regist rollers 103, 104 are easily worn to shorten the service life thereof.

To solve this problem, as disclosed in the Japanese Patent Application Laid-Open No. 61-124447 (1986), there has been proposed a technique in which a friction rotary member is driven again to aid the conveyance of a sheet by means of regist rollers when the sheet is conveyed by the regist rollers.

That is to say, as shown in FIG. 13, a projection 106 is formed on a front end surface of each cassette 100 at a discrete position depending upon a size of the sheet so that, when the cassette 100 is mounted to a sheet supply apparatus, one of switches 107, 108, 109 of the sheet supply apparatus is turned ON by the projection 106, thereby detecting the size of the sheets contained in the cassette 100 in question. Then, after a predetermined loop is formed in the sheet 101 is formed by the regist rollers 103, 104, the friction rotary member 102 is stopped.

Thereafter, when the conveyance of the sheet 101 by the regist rollers 103, 104 is started, the friction rotary member 102 is rotated again until a trailing end of the sheet 101 detected by the switch 107, 108 or 109 reaches the friction rotary member.

However, in this control technique, it is required to provide the switches 107, 108, 109 for detecting the size of the sheet. Particularly, in recent years, image forming apparatuses wherein a number of cassettes 100 can be simultaneously mounted to the image forming apparatus to save time for exchanging the sheets have been put to practical use. In such image forming apparatus, the switches for detecting the size of the sheet are required for the respective cassettes, thereby making the apparatus bulky and expensive.

SUMMARY OF THE INVENTION

The present invention aims to eliminate the above-mentioned conventional drawbacks, and an object of the present invention is to provide a sheet supply apparatus wherein a sheet movement preventing force of a sheet supply means does not act on a sheet convey means with a simple construction.

To achieve the above object, according to the present invention, there is provided a sheet supply apparatus comprising a sheet supply means for supplying stacked sheets one by one, a convey means for conveying the sheet supplied by the sheet supply means toward a downstream direction, a length detection means for detecting the supplied sheet, a memory means for storing the length of the sheet, and a sheet detection means for detecting presence/absence of the sheet, and wherein, when a first sheet is supplied, the length of the sheet is detected by the length detection means and the detected length of the sheet is stored in the memory means, and, when second, third, fourth sheets and so on are supplied, the sheet supply means is operated on the basis of information regarding the sheet length stored in the memory means to aid the conveyance of the sheet until the absence of the sheet is detected by the sheet detection means. Further, there is provided an image forming apparatus comprising the above-mentioned sheet supply apparatus, a scan means for scanning an original, and an image forming means for forming an image on the sheet, and wherein an original scanning speed for the first sheet is changed from an original scanning speed for the second, third sheets and so on.

With the sheet supply apparatus having the above-mentioned construction, since the length detection means for detecting the supplied sheet, the memory means for storing the length of the sheet, and the sheet detection means for detecting presence/absence of the sheet, and since, when a first sheet is supplied, the length of the sheet is detected by the length detection means and the detected length of the sheet is stored in the memory means. And, when second, third, fourth sheets and so on are supplied, the sheet supply means is operated on the basis of information regarding the sheet length stored in the memory means to aid the conveyance of the sheet until the absence of the sheet is detected by the sheet detection means, the auxiliary conveyance in accordance with the length of the sheet can be achieved. Further, in the above-mentioned image forming apparatus comprising the above-mentioned sheet supply apparatus, the scan means for scanning the original, and the image forming means for forming the image on the sheet, since the original scanning speed for the first sheet is changed from the original scanning speed for the second, third sheets and so on, the original scanning speed can be set to correct "shrink" or "contraction" of the image caused by the supply of the first sheet.

DETAILED DESCRIPTION OF THE PREFERRED EMBODIMENTS

The present invention will now be explained in connection with embodiments thereof with reference to the accompanying drawings.

[First Embodiment]

Figure 1:
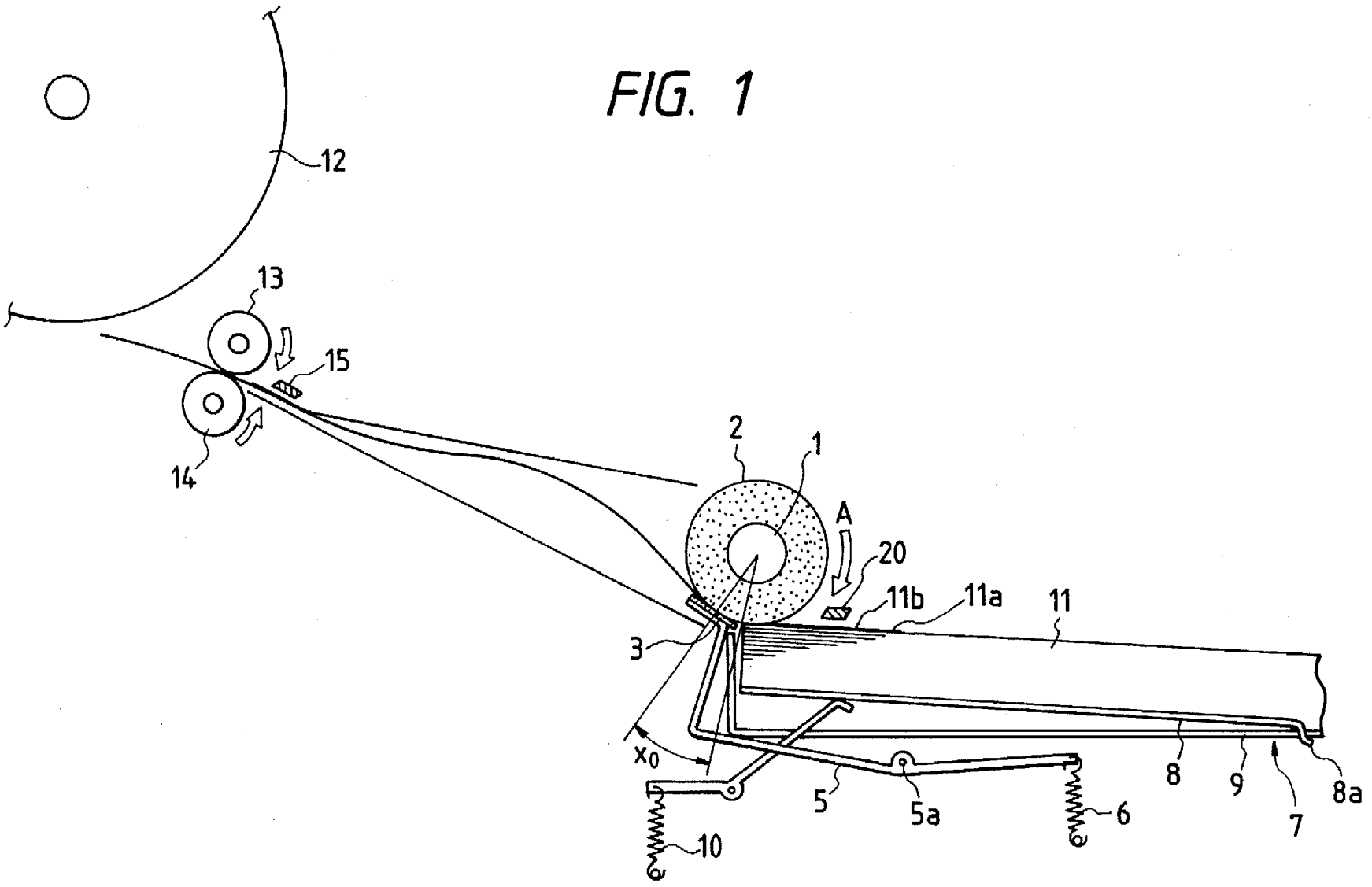
FIG. 1 is a schematic side view showing a sheet supply apparatus according to a first embodiment of the present invention.
Figure 2:
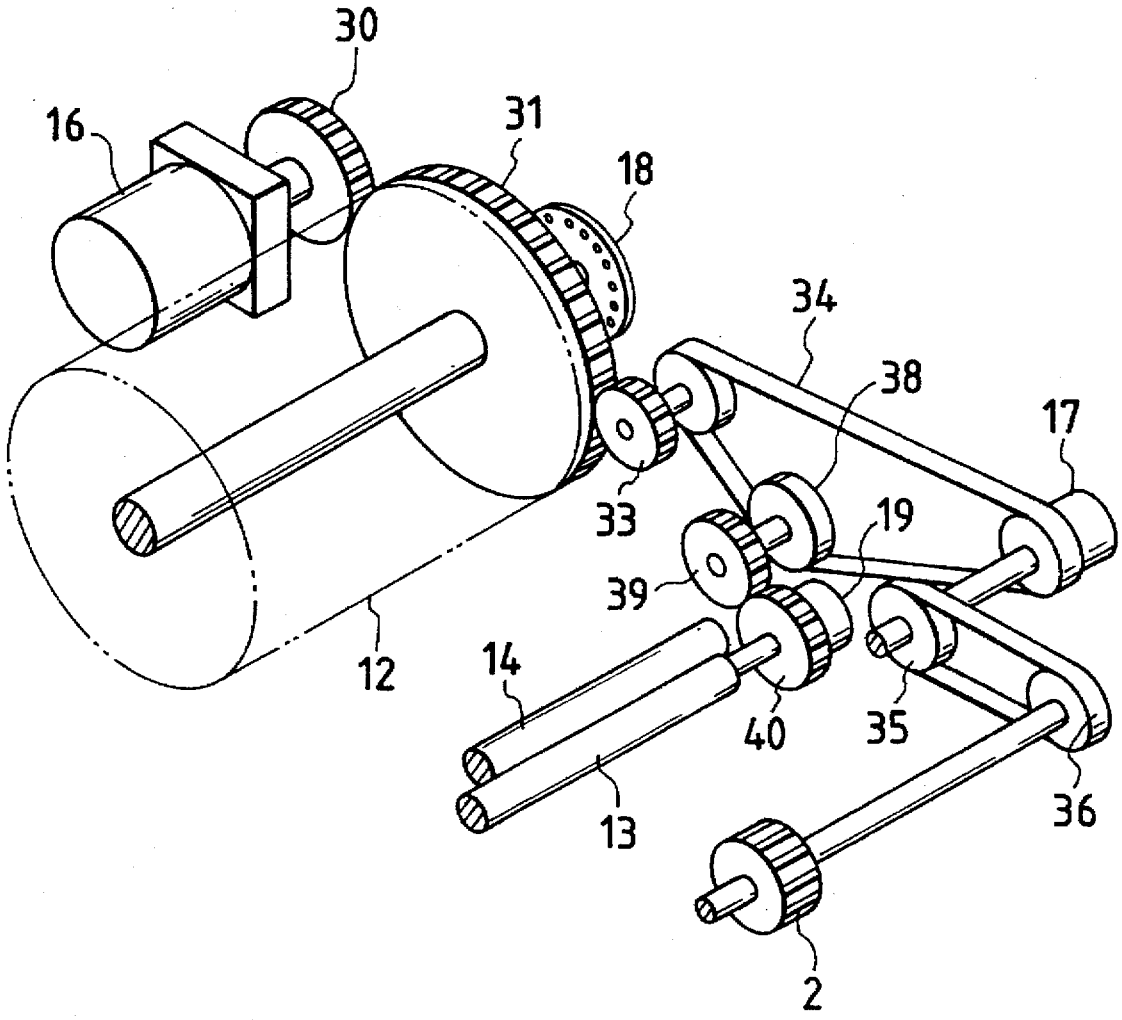
FIG. 2 is a perspective view of a main portion of the sheet supply apparatus of FIG. 1.

FIG. 1 shows a sheet supply apparatus according to a first embodiment of the present invention. The apparatus comprises a friction rotary member (sheet supply means) 2 rotated by a shaft 1, and a friction pad 3 made of rubber or other material such as synthetic resin having a high coefficient of friction. The friction pad 3 is secured to one end of a separation member 5 pivotally mounted on a support pin 5*a* and is urged against the friction rotary member 2 with predetermined pressure by means of a spring 6 connected to the other end of the separation member 5. A sheet supply cassette 7 is removably mounted in a sheet supply portion in a confronting relation to the friction rotary member 2. The sheet supply cassette 7 is constituted by a sheet stacking plate 8 having a free end biased toward the friction rotary member 2 by a spring 10, and a box-shaped container 9 for supporting a pivot end 8 of the sheet stacking plate 8 and for containing a plurality of sheets.

An uppermost sheet among the plurality of sheets 11 stacked on the sheet stacking plate 8 is contacted with the friction rotary member 2 so that, when the friction rotary member is rotated in a direction shown by the arrow A, the uppermost sheet is fed out from the cassette due to the friction force between the sheet and the friction rotary member. If two or more sheets are fed out simultaneously, an advancing movement of a lower sheet 11 is prevented by the friction pad 3 urged against the friction rotary member, thereby preventing the double-feed of the sheets. Further, a sensor 20 for detecting the presence/absence of the sheet 11 is disposed in the vicinity of the friction rotary member 2.

The separated sheet 11 is fed to a pair of regist rollers (convey means) 13, 14 for effecting the registration between a toner image formed on a photosensitive drum 12 and a tip end of the sheet 11.

A sensor (length detection means) 15 for detecting a length of the sheet 11 is disposed at an upstream side of the paired regist rollers 13, 14 to detect the tip end of the sheet 11 and emit a detection signal. The stop timing of the friction rotary member 2 is controlled on the basis of the detection signal to form a proper loop in the sheet between the friction rotary member 2 and the regist rollers 13, 14 by the sensor 15 and a timer means for counting or measuring a time corresponding to a distance between the friction rotary member and the regist rollers 13, 14. It is well known to form the loop in the sheet to correct the skew-feed of the sheet. The regist rollers 13, 14 are rotated in response to an image tip end synchronous signal emitted from an optical device (not shown) for exposing the photosensitive drum 12 or the image, thereby conveying the sheet 11 onto the photosensitive drum 12 again, where the toner image on the photosensitive drum is transferred onto the sheet.

Next, a control method will be explained with reference to FIGS. 2 to 4B.

Figure 4A:
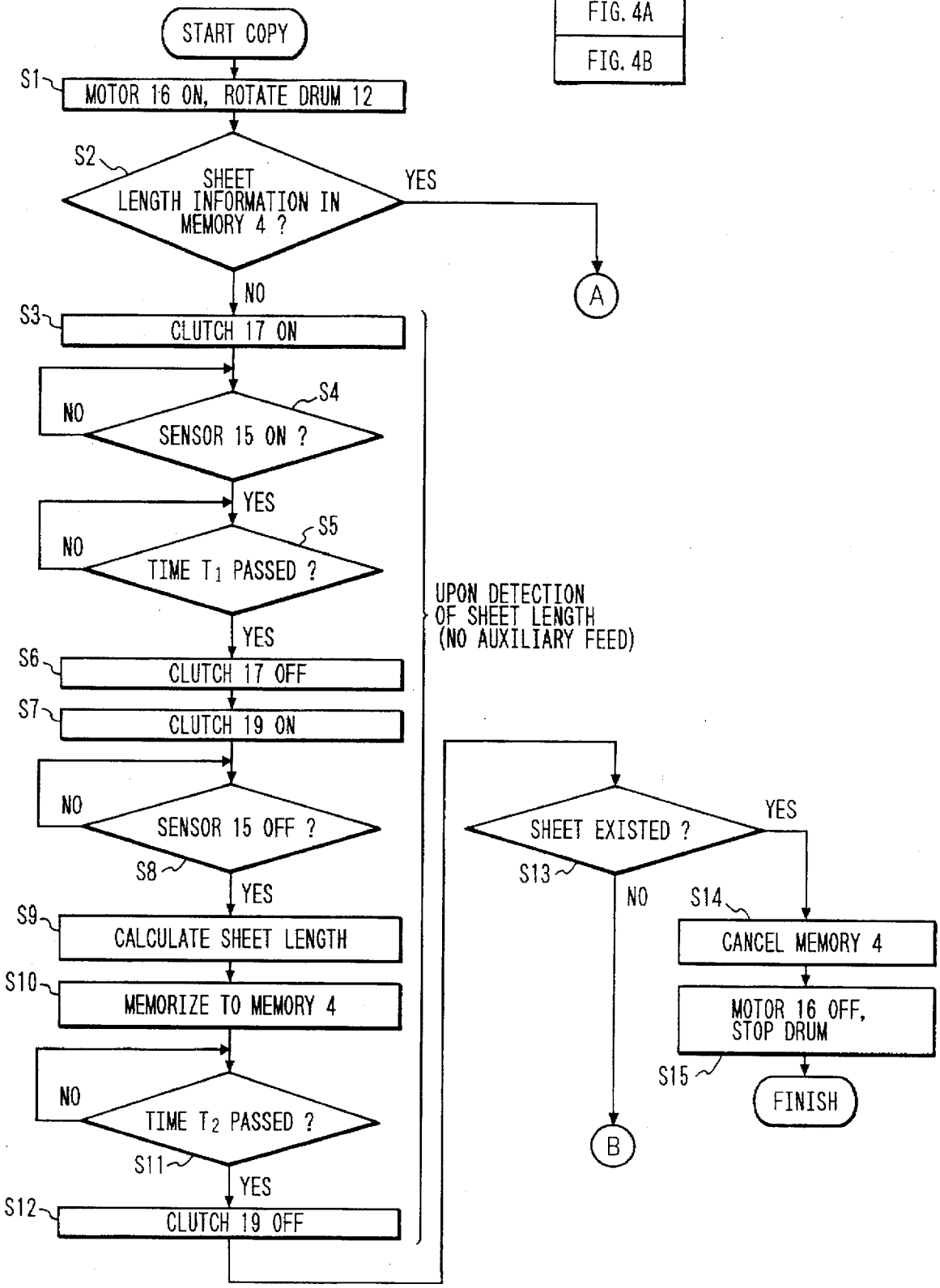
FIG. 4 is comprised of FIGS. 4A and 4B showing control flow charts of the sheet supply apparatus of FIG. 1.
Figure 4:
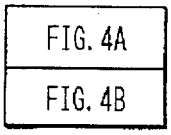
Figure 4B:
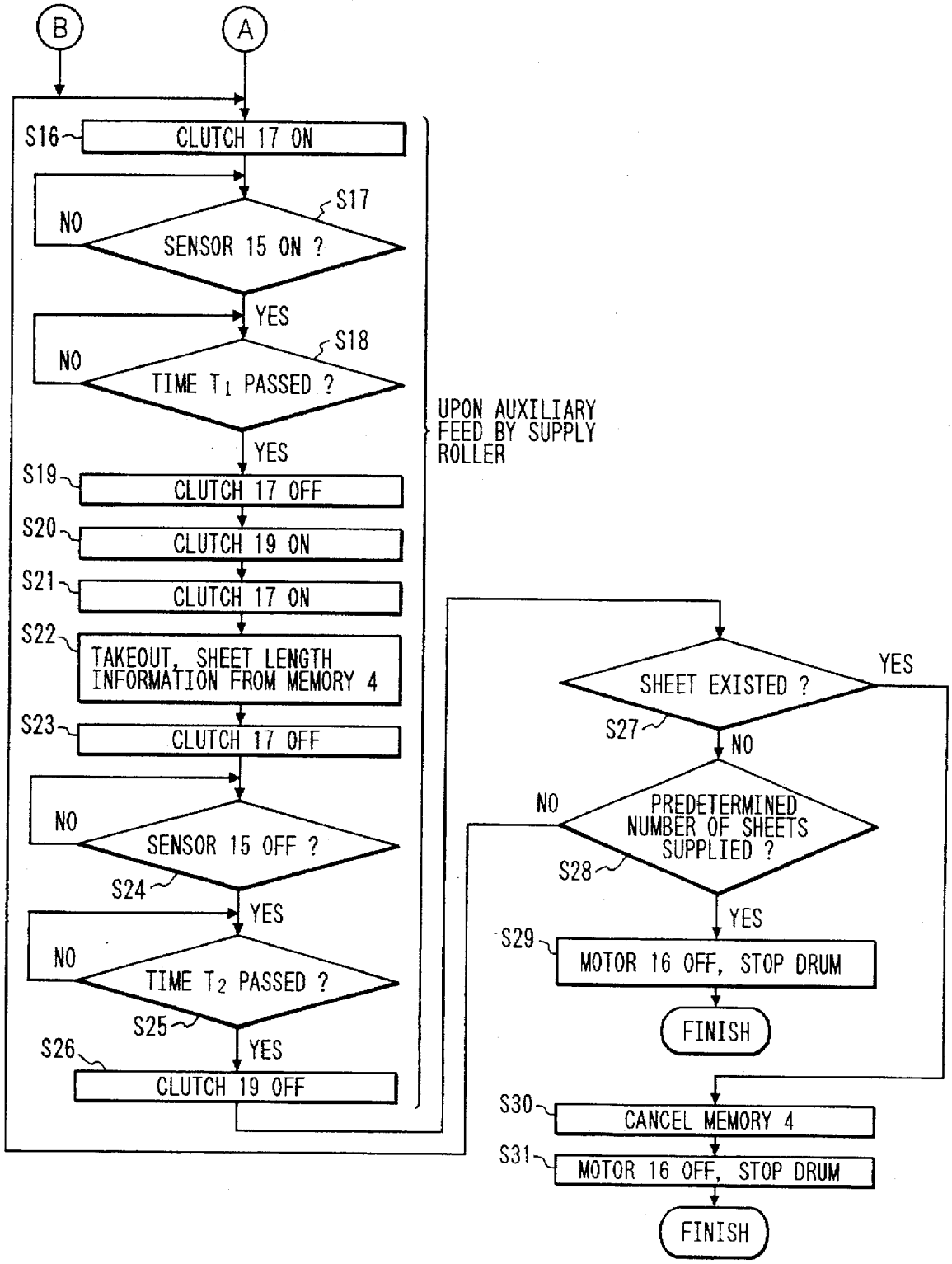

When a motor 16 starts to be rotated, the photosensitive drum 12 is rotated through gears 30, 31 (step S1 in FIG. 4A). At this point, if information regarding the length of the sheet is not stored in a memory 4, after a predetermined time is elapsed, a sheet supply clutch 17 is turned ON to transmits driving force to the friction rotary member 2, thereby starting the supply of the sheet (step S3). That is to say, the rotation of the gear 31 is transmitted to the friction rotary member 2 through a gear 33, a belt 34, the clutch 17, a pulley 35 and a belt 36, thereby rotating the friction rotary member. The sheets 11 are separated one by one by the separation pad 15. When the tip end of the separated sheet is detected by the sensor 15, after a predetermined time T1 is elapsed, the clutch 17 is turned OFF; meanwhile, a loop is formed on the sheet between the regist rollers 13, 14 and the friction rotary member 2 (steps S4 to S6).

Then, a regist clutch 19 is turned ON in response to a signal from a clock pulse means 18 rotating in synchronous with the drum 12 to effect the registration between the toner image formed on the photosensitive drum 12 and the tip end of the sheet 11, thereby transmitting the driving force to the regist roller 13 (also rotating the driven regist roller 14 by the rotation of the regist roller 13), with the result that the sheet 11 is conveyed toward the drum 12 (step S7). That is to say, the rotation of the gear 31 is transmitted to the regist roller 13 through the gear 33, belt 34, pulley 38, gear 39, gear 40 and regist clutch 19.

When the trailing end of the sheet 11 passes through the sensor 15, the signal from the sensor 15 is turned OFF (step S8). From this signal, the length L of the sheet 11 in a conveying direction can be detected. That is to say, when a distance between the sensor 15 and the regist rollers 13, 14 is d, a conveying speed of the sheet 11 is v and a time period from ON of the regist clutch 19 to OFF of the sensor 15 is t, the length l of the sheet 11 in the conveying direction can be determined by the following equation (1) (step S9):

$$L=vt+d \quad (1)$$

The information regarding the length of the sheet 11 determined in this way is stored in the memory (memory means) 4 (step S10). When a predetermined time T2 is elapsed after the trailing end of the sheet 11 passes through the sensor 15, the regist clutch 19 is turned OFF, thereby preparing for a next sheet (steps S11, S12). When the sensor detects the absence of sheet, the information regarding the length of the sheet stored in the memory 4 is canceled, the motor 16 is turned OFF and the photosensitive drum 12 is stopped (steps S13 to S15). In the step S13, if the absence of sheet is not detected, the sheet supply clutch 17 is turned ON at a predetermined timing, thereby starting the supply of the next sheet (step S16).

As is in the first sheet, a loop is formed in the next sheet between the regist rollers 13, 14 and the friction rotary member 2, and the regist clutch 19 is turned ON at a predetermined timing (steps S17 to S20). After the regist clutch 19 is turned ON, the sheet supply clutch 17 is turned ON again, thereby starting the auxiliary supply of the sheet (step S21). The time delay from ON of the regist clutch 19 to ON of the sheet supply clutch 17 is provided, in consideration of difference in response speed between the clutches, in order that the excessive loop is formed in the sheet to buckle the sheet if the sheet supply clutch 17 is turned ON before the regist clutch 19 is turned ON. In other words, the sheet supply clutch 17 may be turned ON before the loop in the sheet is disappeared due to the delay in the actuation of the clutch.

Then, after a predetermined time is elapsed, the clutch 17 is turned OFF (step S23), thereby stopping the friction rotary member 2 again. The turn-OFF timing of the clutch 17 may be selected so that the clutch is turned OFF before the trailing end of the sheet 11 passes through a nip between the friction rotary member 2 and the friction pad 3, by calculating a distance between the above nip and the trailing end of the sheet 11.

When a time period from ON of the clutch 17 in the step S21 to OFF of the clutch 17 in the step S23 is T3, the time period T3 can be determined by the following equation:

$$L+x_0=D+vT3$$

where, $x_0$ is a distance from a tip end of the sheet stack 11 to the nip between the friction rotary member 2 and the friction pad 3, and D is a distance that the sheet 11 is conveyed by the friction rotary member 2 during the steps S16–S19.

Incidentally, steps S24–S27 are the same as the steps S8–S13 for the first sheet.

The above-mentioned sequence is repeated until a predetermined number of sheets are treated. When the supply of the predetermined number of sheets is finished, the motor 16 is turned OFF and the photosensitive drum 12 is stopped (steps S28–S31). In the next copying operation, since the information regarding the length of the sheet is stored in the memory 4, the auxiliary supply can be effected by the friction rotary member 2, regarding the second, third sheet and so on. On the other hand, it can be designed so that the information regarding the length of the sheet is kept to be stored in the memory 4 even when the power source is turned OFF. In this case, the auxiliary supply of the sheet can be effected on the basis of the information regarding the length of the sheet stored in the memory 4 immediately after the power source is turned ON again.

In the above-mentioned embodiment, while an example that the stationary friction pad 3 urged against the friction rotary member is used as the sheet double-feed preventing means was explained, in place of the friction pad, a friction rotary member urged against the friction rotary member 2 and rotated in a direction opposite to that of the friction rotary member 2 may be used to achieve the same technical advantage.

Figure 5:
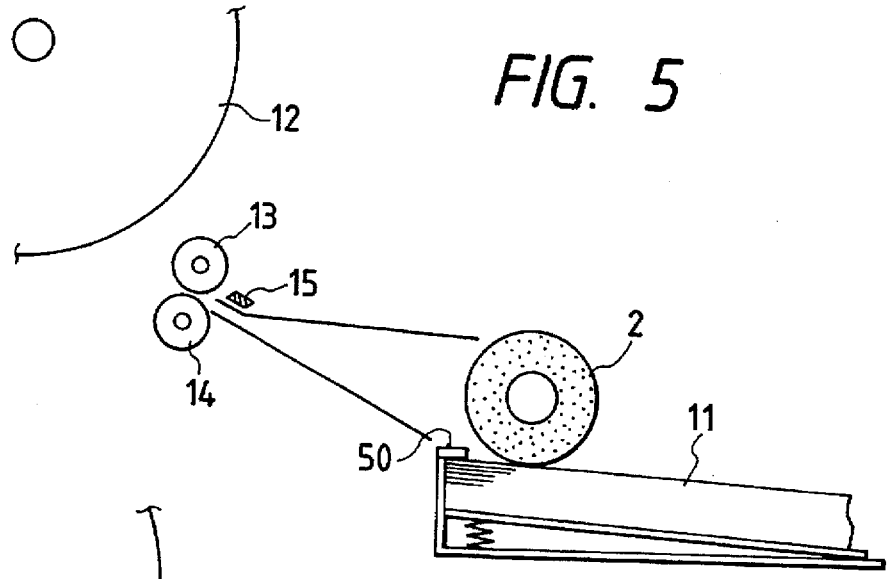
FIG. 5 is a schematic side view showing a sheet supply apparatus according to an alteration of the present invention.

In addition, a cassette using a separation pawl 50 as shown in FIG. 5 can be applied to the present invention.

Incidentally, as the convey means, a regist pawl may be additionally disposed at an upstream side of the paired regist rollers so that the tip end of the sheet can abut against the regist pawl. In this case, the regist rollers are normally called as "convey rollers".

As mentioned above, according to the first embodiment of the present invention, since the length of the sheet is measured and stored in the memory 4 during the supply of the first sheet and the friction rotary member 2 is rotated with the time delay for the next sheet supply operation and so on by the simple construction and control, the service life (endurance) of the regist rollers 13, 14 can be remarkably improved.

[Second Embodiment]

In the above-mentioned first embodiment, while the auxiliary supply of the sheet by the friction rotary member 2 cannot be effected regarding the first sheet (because the length of the first sheet must be detected). Thus, the conveyance of the first sheet by the regist rollers 13, 14 may be obstructed to decrease the conveying speed of the sheet 11. In this case, the image on the first sheet may be subjected to "shrink" or "contraction", thereby making the image on the first sheet ugly.

In the second embodiment, the obstruction of the conveyance of the first sheet 11 (effected by the regist rollers 13, 14) and the shrink of the image on the first sheet can be avoided.

Figure 7:
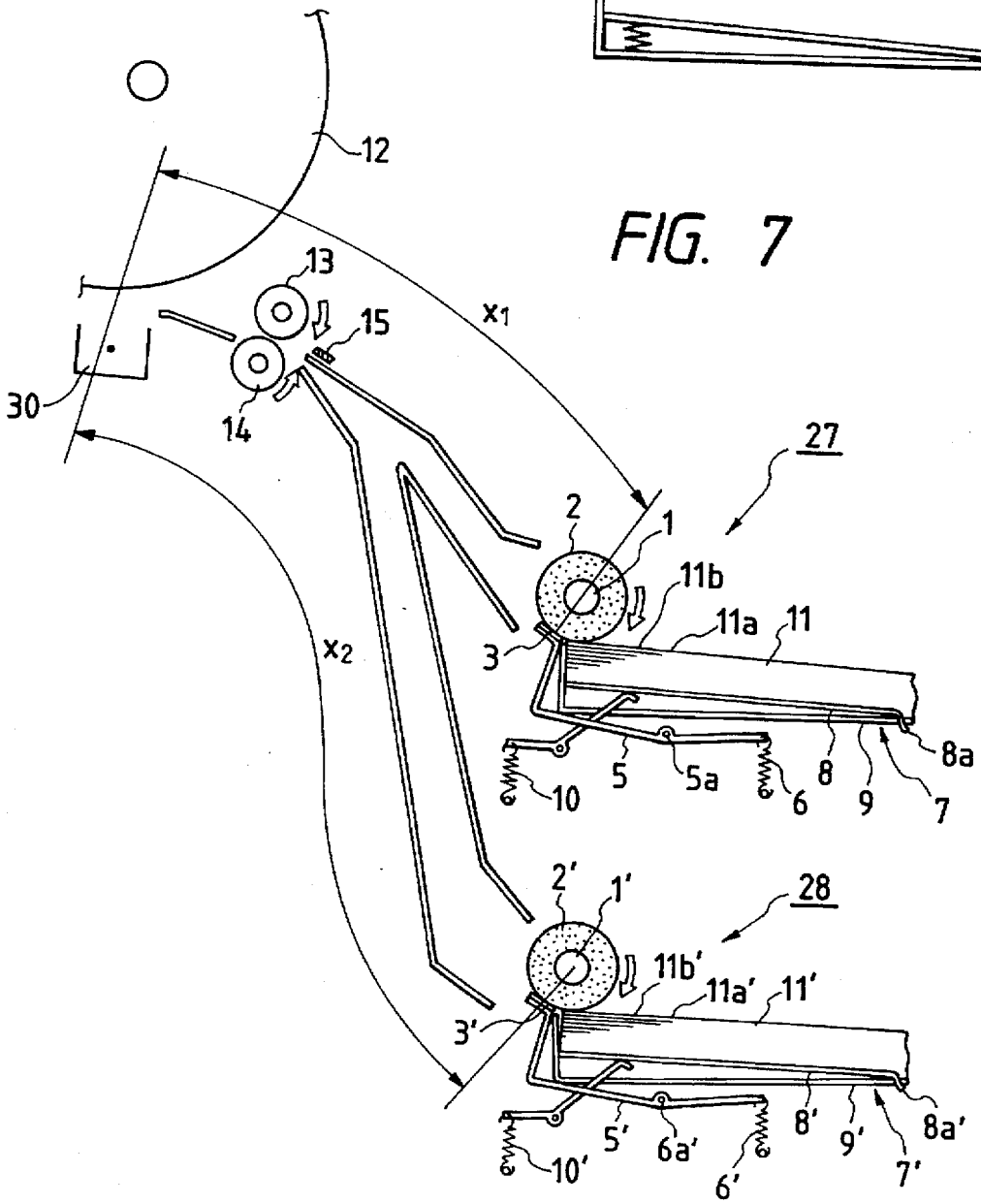
FIG. 7 is a side view showing a main portion of the image forming apparatus of FIG. 6.
Figure 6:
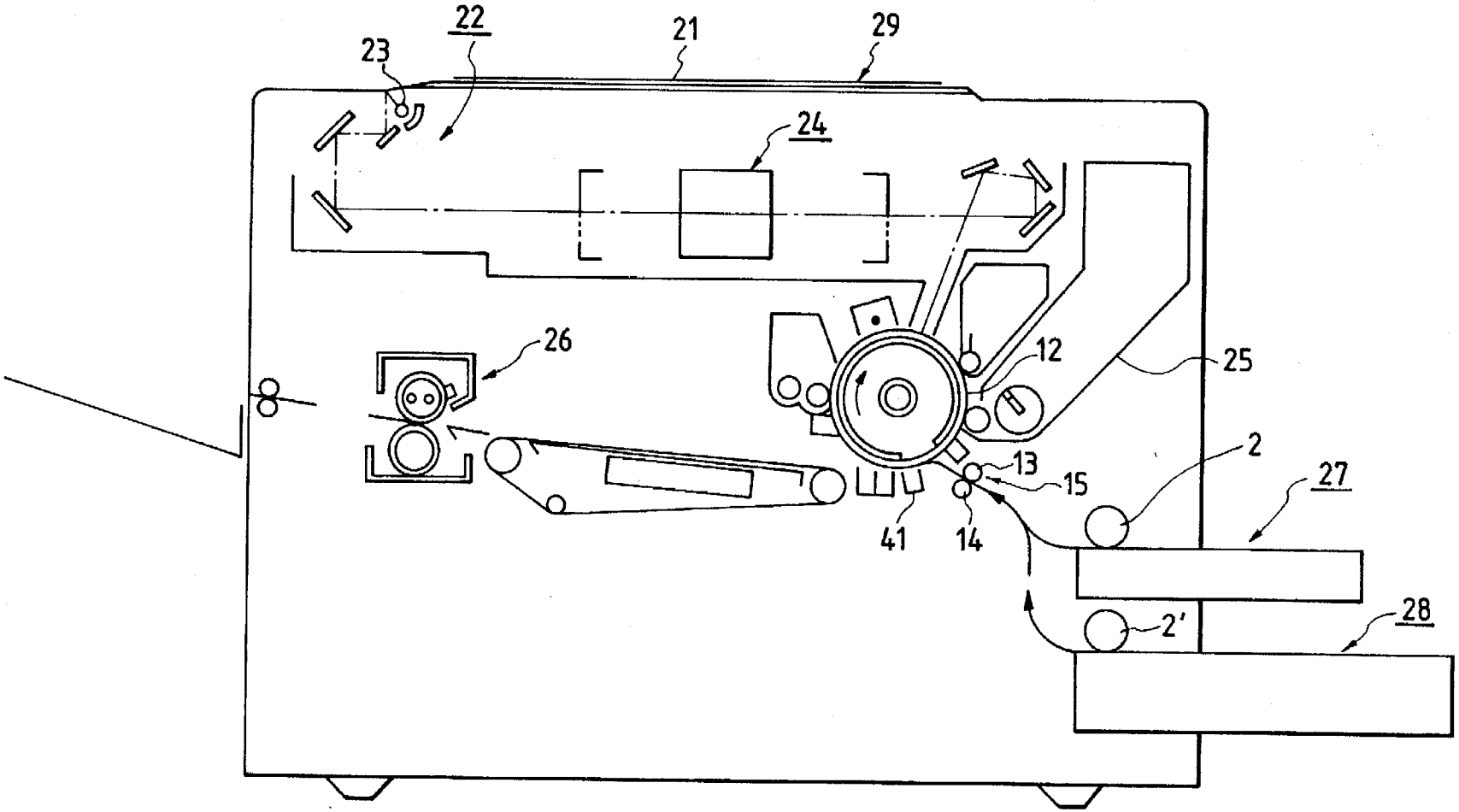
FIG. 6 is a schematic elevational sectional view showing an image forming apparatus to which a sheet supply apparatus according to a second embodiment of the present invention is applied.

FIGS. 6 and 7 show an image forming apparatus to which a sheet supply apparatus according to a second embodiment of the present invention is applied (incidentally, the same elements as those in the first embodiment are designated by the same reference numerals).

Figure 8:
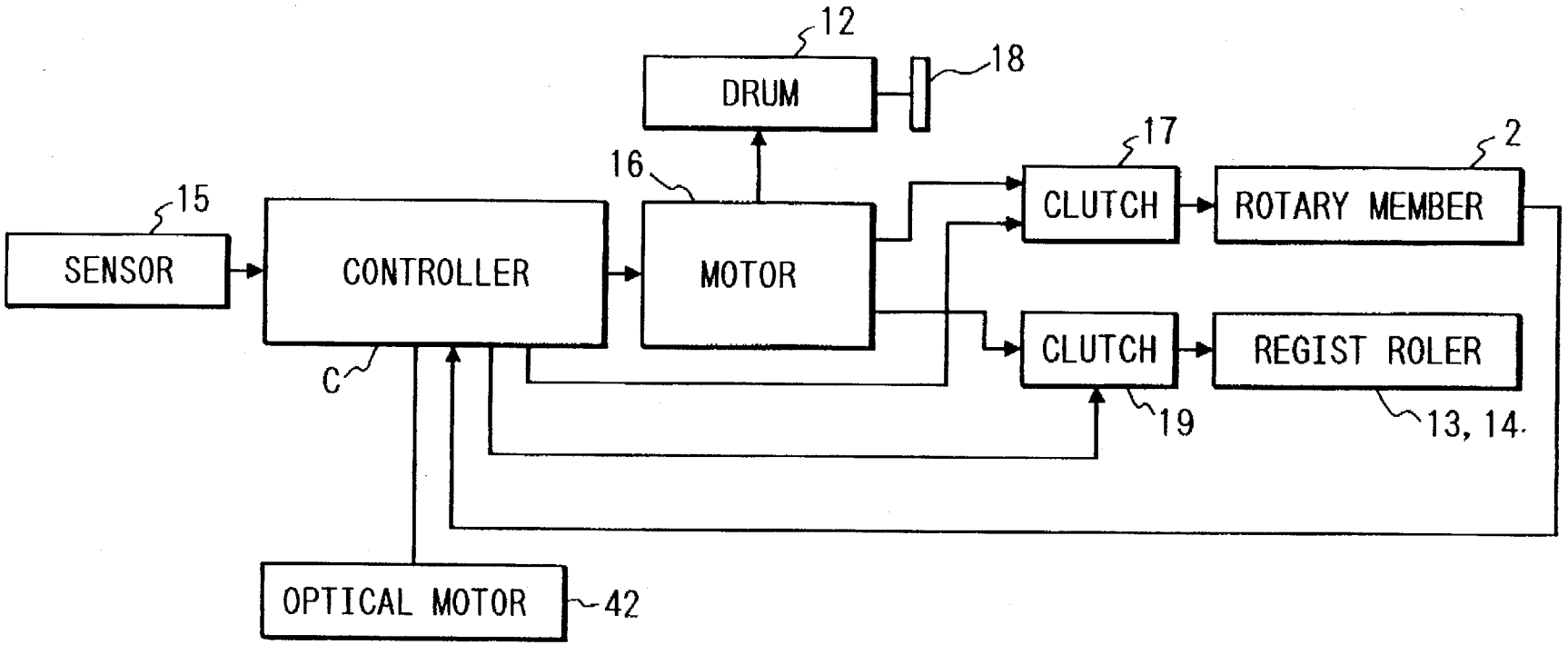
FIG. 8 is a block diagram of the image forming apparatus of FIG. 6.

In this second embodiment, an original 29 rested on an original support glass plate 21 is scanned by shifting an optical device 22 (scan means having mirrors) a scan speed (described later) while illuminating light from an illumination device 23 onto the original. Incidentally, the optical device 22 is driven by a motor 42 (FIG. 8) comprising a stepping motor and the like (not shown), and the scan speed can freely be adjusted on the basis of a signal from a controller C (FIG. 8). The scanned light image is formed on a photosensitive layer on a rotating drum 12 as a latent image through a lens 24, and the latent image is visualized as a toner image by means of a developing device 25. The toner image is transferred onto the sheet at a transfer portion 41. Then, the sheet is sent to a fixing device 26, where the toner image is fixed to the sheet. Thereafter, the sheet is discharged out of the image forming apparatus. On the other hand, the sheet 11 is supplied from a sheet supply portion 27 or 28.

FIG. 7 shows the sheet supply portions 27, 28 in detail. The sheet supply portion 27 (28) comprises a friction rotary member (sheet supply means) 2 rotated by a shaft 1, and a friction pad 3 made of rubber or other material such as synthetic resin having a high coefficient of friction. The friction pad 3 is secured to one end of a separation member 5 pivotally mounted on a support pin 5*a* and is urged against the friction rotary member 2 with predetermined pressure by a spring 6 connected to the other end of the separation member 5. A sheet supply cassette 7 is removably mounted in a sheet supply portion in a confronting relation to the friction rotary member 2. The sheet supply cassette 7 is constituted by a sheet stacking plate 8 having a free end biased toward the friction rotary member 2 by means of a spring 10, and a box-shaped container 9 for supporting a pivot end 8 of the sheet stacking plate 8 and for containing a plurality of sheets.

An uppermost sheet 11*a* among the plurality of sheets 11 stacked on the sheet stacking plate 8 is contacted with the friction rotary member 2 so that, when the friction rotary member is rotated in a direction shown by the arrow A, the uppermost sheet is fed out from the cassette due to the friction force between the sheet and the friction rotary member. If two or more sheets are fed out simultaneously, an advancing movement of a lower sheet 11 is prevented by the friction pad 3 urged against the friction rotary member, thereby preventing the double-feed of the sheets.

The separated sheet 11 is fed to a pair of regist rollers (convey means) 13, 14 for effecting the registration between a toner image formed on a photosensitive drum 12 and a tip end of the sheet 11.

A sensor 15 for detecting a length of the sheet 11 is disposed at an upstream side of the paired regist rollers 13, 14 to detect the tip end of the sheet 11 and emit a detection signal. The stop timing of the friction rotary member 2 is controlled on the basis of the detection signal to form a proper loop in the sheet between the friction rotary member 2 and the regist rollers 13, 14 by the sensor 15 and a timer means for counting or measuring a time corresponding to a distance between the friction rotary member and the regist rollers 13, 14.

The loop is formed in the sheet to correct the skew-feed of the sheet. The regist rollers 13, 14 are rotated in response to an image tip end synchronous signal emitted from an optical device 22 for exposing the photosensitive drum 12 or the image, thereby conveying the sheet 11 onto the photosensitive drum 12 again, where the toner image on the photosensitive drum is transferred onto the sheet.

Next, a control method will be explained with reference to FIGS. 7 to 9B and FIG. 2.

Figures 9, 9A:
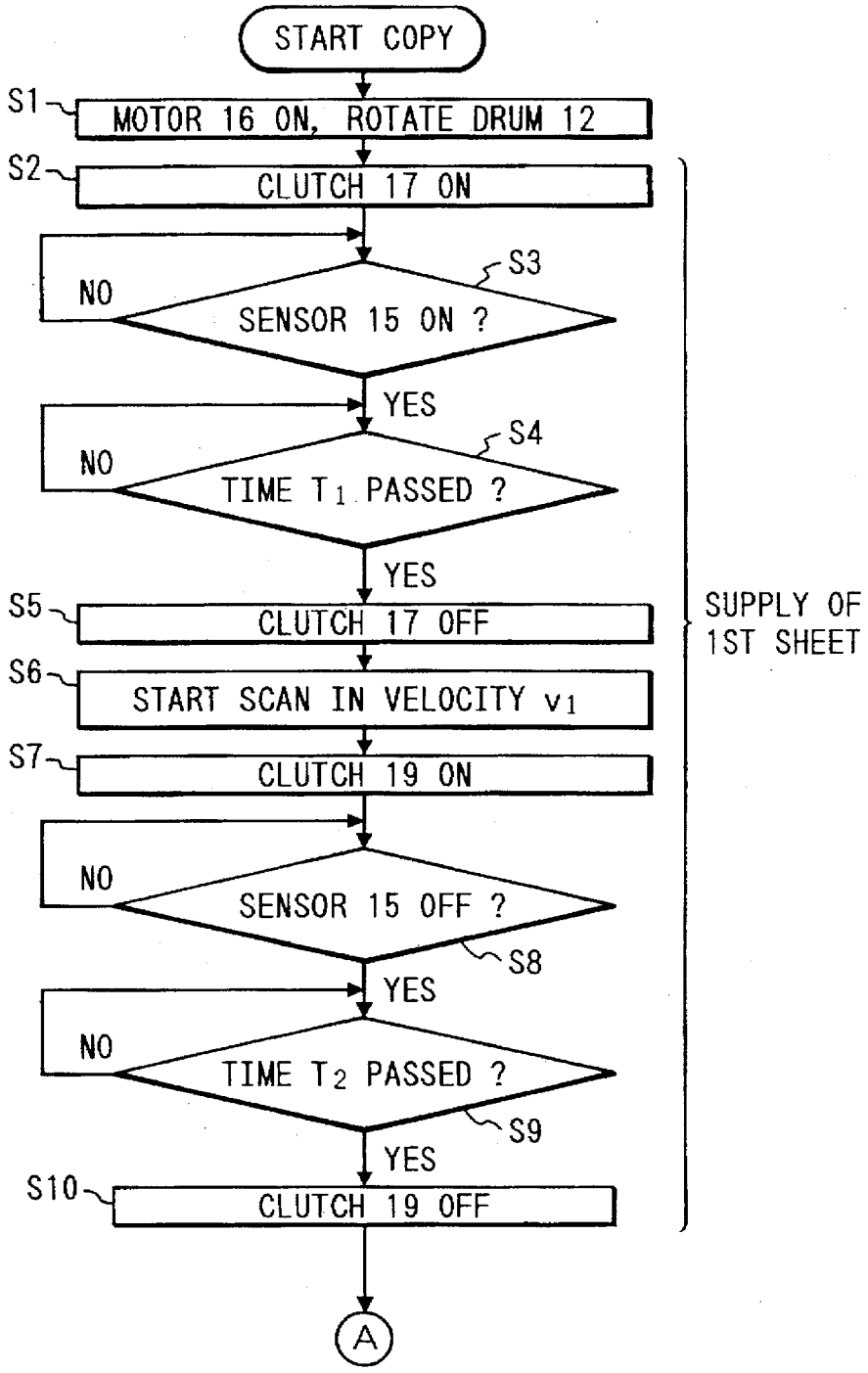
FIG. 9 is comprised of FIGS. 9A and 9B showing control flow charts of the image forming apparatus of FIG. 6.
Figure 9B:
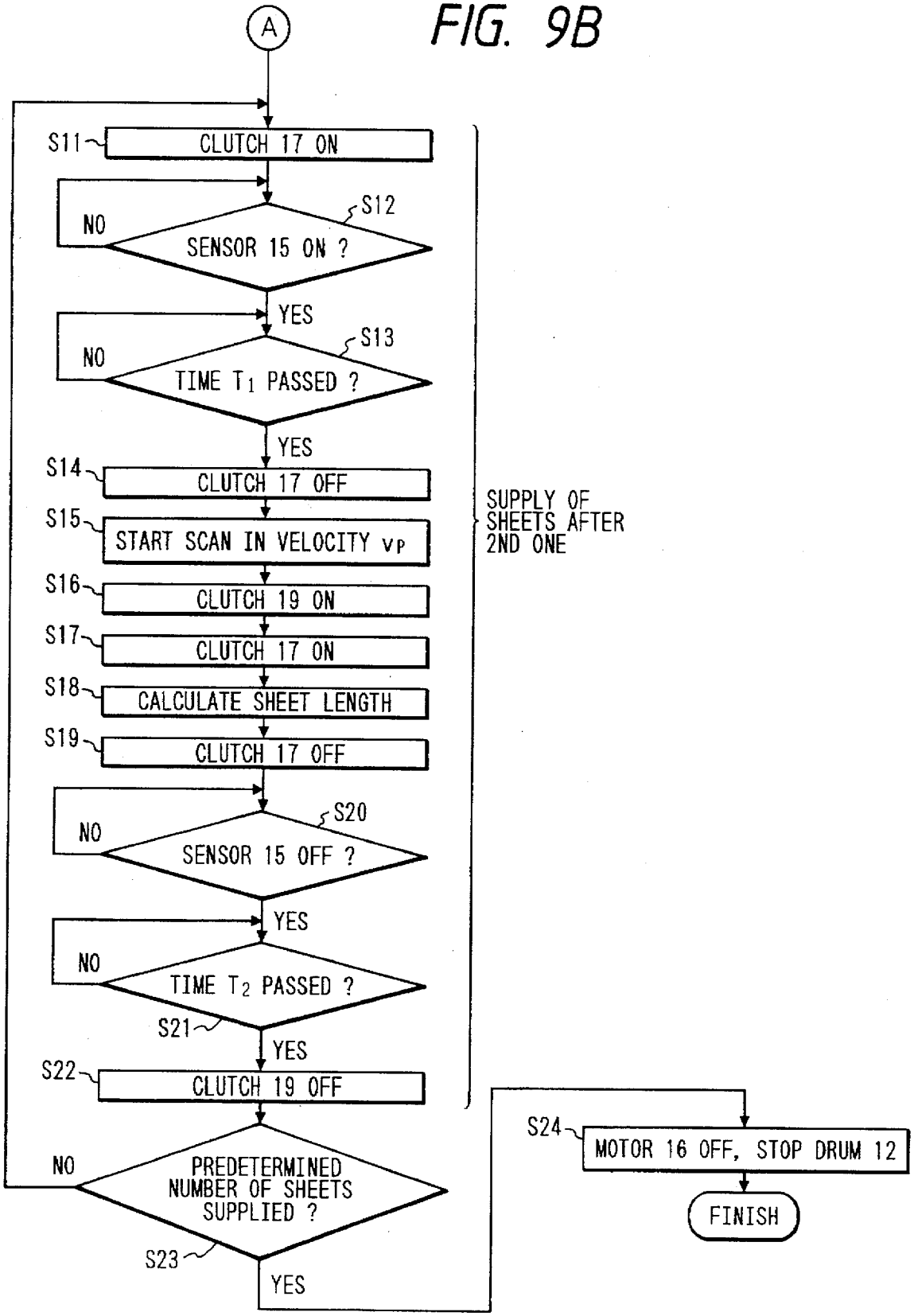

When a motor 16 starts to be rotated, the photosensitive drum 12 is rotated through gears 30, 31, and, after a predetermined time is elapsed, a sheet supply clutch 17 is turned ON to transmit a driving force to the friction rotary member 2, thereby starting the supply of the sheet 11 (steps S1 and S2 in FIG. 9A). That is to say, the rotation of the gear 31 is transmitted to the friction rotary member 2 through a gear 33, a belt 34, the clutch 17, a pulley 35 and a belt 36, thereby rotating the friction rotary member 2. The sheets 11 are separated one by one by the separation pad 15. When the tip end of the separated sheet is detected by the sensor 15, after a predetermined time T1 is elapsed, the clutch 17 is turned OFF; meanwhile, a loop is formed on the sheet between the regist rollers 13, 14 and the friction rotary member 2 (steps S3 to S5).

Then, the scanning of the optical device 22 at a speed of $v_1$ (described later) is started (step S6), thereby forming the toner image on the photosensitive drum 12 as mentioned above. Then, a regist clutch 19 is turned ON in response to a signal from a clock pulse means 18 rotating in synchronous with the drum 12 to effect the registration between the toner image formed on the photosensitive drum 12 and the tip end of the sheet 11, thereby transmitting the driving force to the regist roller 13 (also rotating the driven regist roller 14 by the rotation of the regist roller 13), with the result that the sheet 11 is conveyed toward the drum 12 (step S7). That is to say, the rotation of the gear 31 is transmitted to the regist roller 13 through the gear 33, belt 34, pulley 38, gear 39, gear 40 and regist clutch 19.

When the trailing end of the sheet 11 passes through the sensor 15, the signal from the sensor 15 is turned OFF (step S8). From this signal, the length L of the sheet 11 in a conveying direction can be detected. That is to say, when a distance between the sensor 15 and the regist rollers 13, 14 is d a process speed is $v_p$ and a time period from ON of the regist clutch 19 to OFF of the sensor 15 is t, the length L of the sheet 11 in the conveying direction can be determined by the following equation (2):

$$L=v_p t+d \tag{2}$$

When a predetermined time T2 is elapsed after the trailing end of the sheet 11 passes through the sensor 15, the regist clutch 19 is turned OFF, thereby preparing for a next sheet (step S10).

Next, explaining the supply of a second sheet and so on (steps S11–S24), the sheet supply clutch 17 is turned ON at a predetermined timing, thereby starting the supply of the next sheet (step S11). As is in the first sheet, after a predetermined loop is formed in the next sheet between the regist rollers 13, 14 and the friction rotary member 2, the sheet supply clutch 17 is turned OFF (steps S12–S14). Then, the scanning of the optical device 22 at a speed of $v_p$, (described later) is started, thereby forming the toner image on the photosensitive drum 12 as is in the first sheet. Then, the regist clutch 19 is turned ON at a predetermined timing.

After the regist clutch 19 is turned ON, the sheet supply clutch 17 is turned ON again, thereby starting the auxiliary supply of the sheet (step S17). The time delay from ON of the regist clutch 19 to ON of the sheet supply clutch 17 is provided, in consideration of difference in response speed between the clutches, in order that the excessive loop is formed in the sheet to buckle the sheet if the sheet supply clutch 17 is turned ON before the regist clutch 19 is turned ON. In other words, the sheet supply clutch 17 may be turned ON before the loop in the sheet is disappeared due to the delay in the actuation of the clutch.

Then, after a predetermined time is elapsed, the sheet supply clutch 17 is turned OFF (step S19), thereby stopping the friction rotary member 2 again. The turn-OFF timing of the clutch 17 may be selected so that the clutch is turned OFF before the trailing end of the sheet 11 passes through a nip between the friction rotary member 2 and the friction pad 3, by calculating a distance between the above nip and the trailing end of the sheet 11 (step S18). Incidentally, steps S20–S22 are the same as the steps S8–S10 for the first sheet.

As mentioned above, since the auxiliary supply of the sheet is effected by the friction rotary member 2 until the trailing end of the sheet 11 reaches the friction rotary member, there is no load acting on the regist rollers 13, 14 during the conveyance of the sheet. The above-mentioned sequence is repeated until a predetermined number of sheets are treated. When the supply of the predetermined number of sheets is finished, the motor 16 is turned OFF and the photosensitive drum 12 is stopped (steps S23–S24).

Figure 10A:
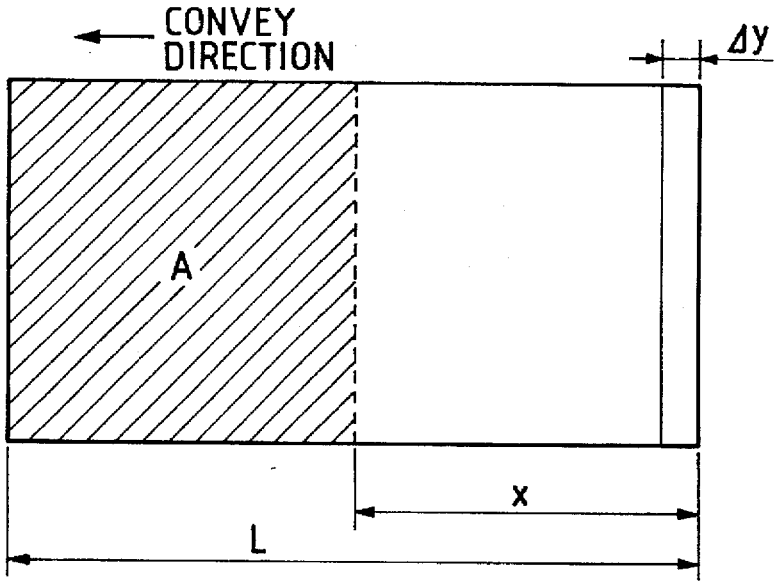
FIGS. 10A and 10B are plan views showing image shrink areas of first sheets.
Figure 10B:
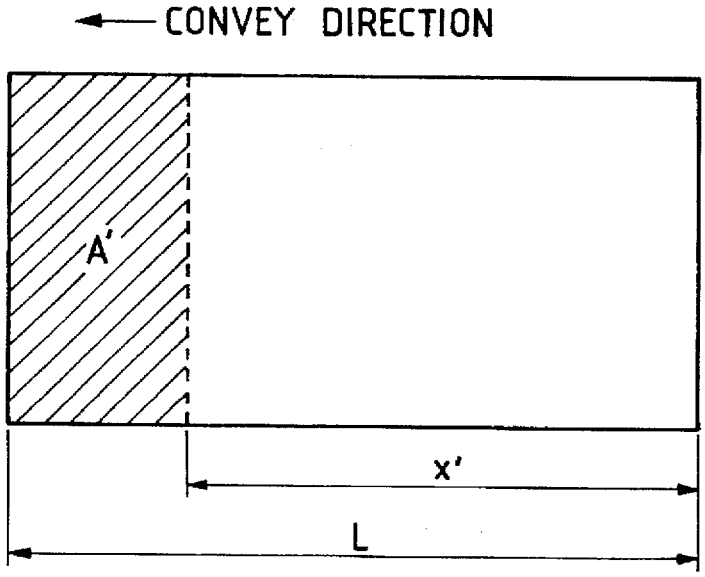
Figure 11:
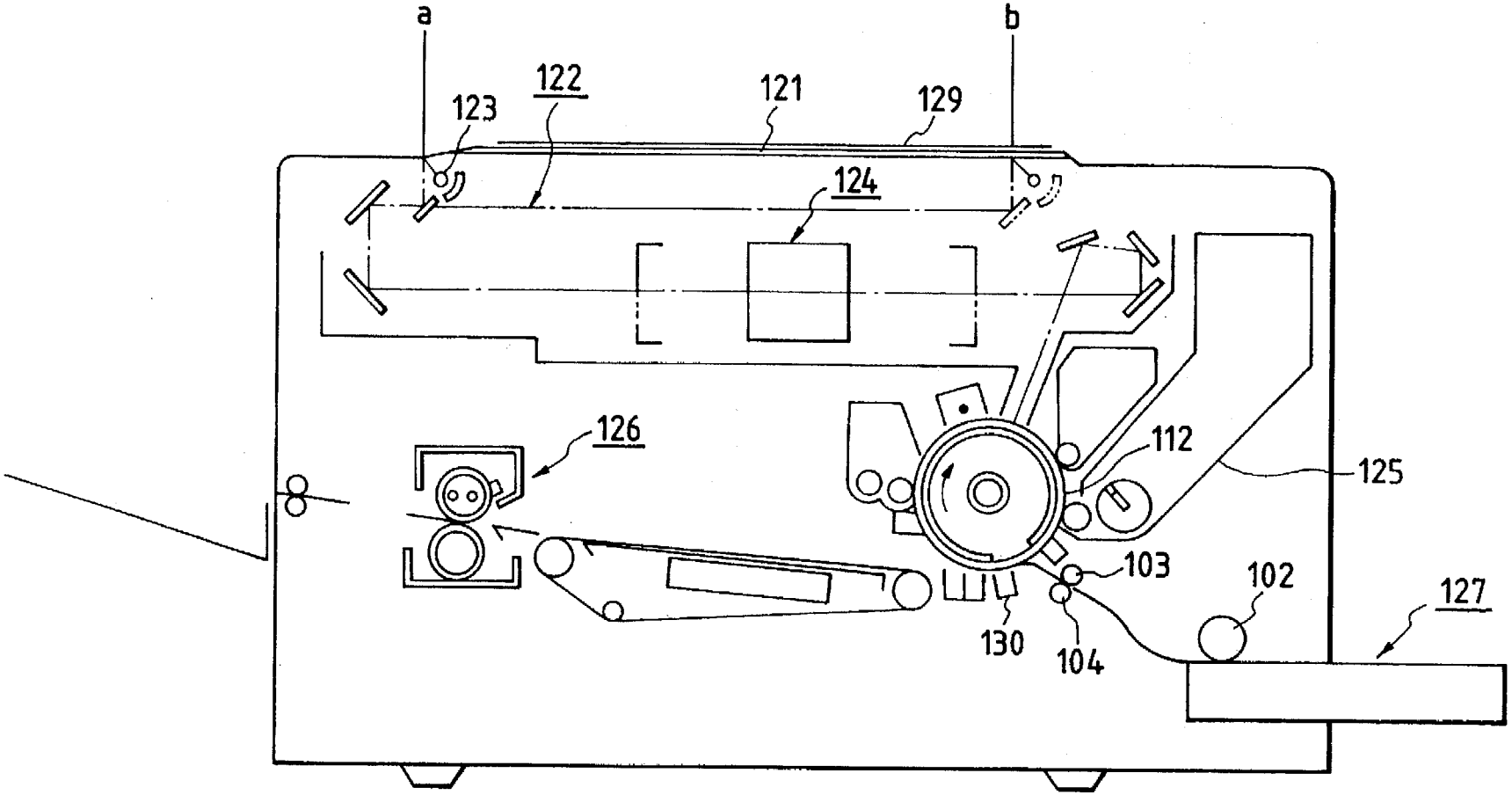
FIG. 11 is a schematic elevational sectional view of a conventional image forming apparatus to which a conventional sheet supply apparatus is applied.
Figure 12:
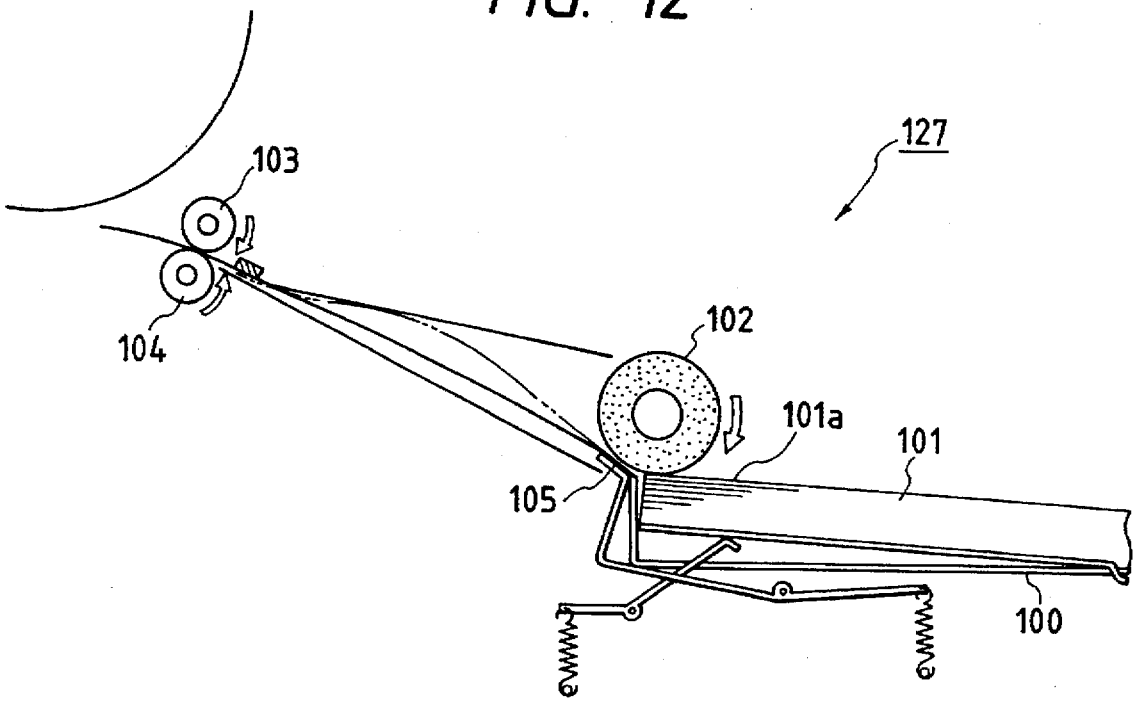
FIG. 12 is a side view showing a main portion of the image forming apparatus of FIG. 11.
Figure 13:
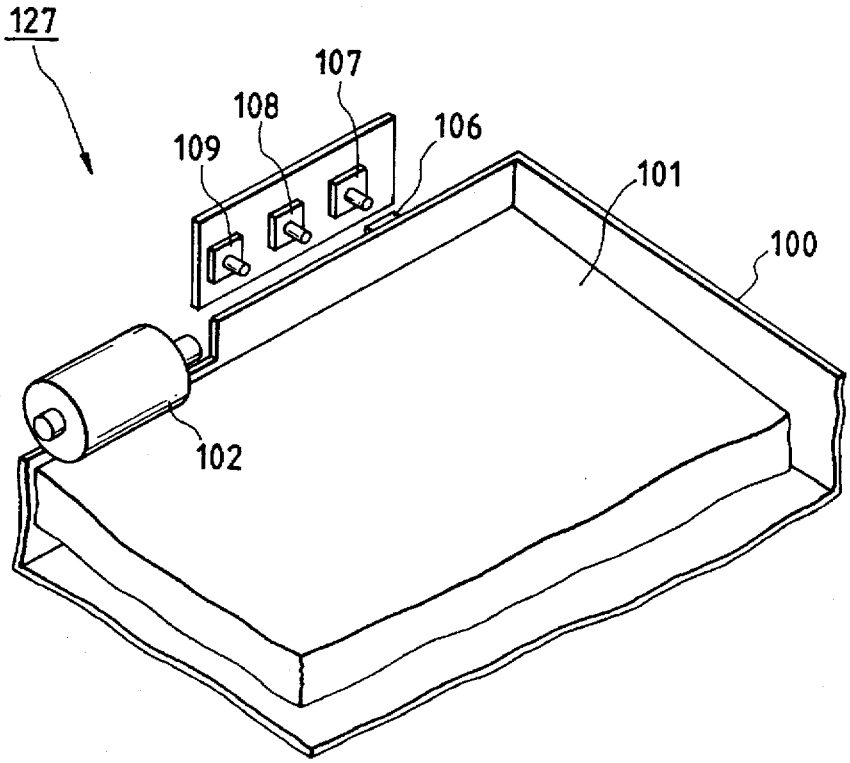
FIG. 13 is a perspective view showing a switch array for detecting sizes of sheets applied to the conventional sheet supply apparatus.

Next, explaining the original scanning speed of the optical device 22, as mentioned above, during the supplying operation for the first sheet 11, since the auxiliary supply by means of the friction rotary member 2 cannot be effected, the load is applied to the regist rollers 13, 14 to generate minute slip between the regist rollers and the sheet, with the result that the sheet conveying speed is decreased until the trailing end of the sheet passes through the nip between the friction rotary member 2 and the friction pad 3 (an area A shown in FIG. 10A; in FIG. 10A, x is a distance between the nip and a transfer portion 41).

When the convey speed in this case is $v_a$, a shrink amount $\Delta y$ of the image in the area A can be determined by the following equation (3):

$$\Delta y=\{(v_p/v_a)-1\}\times(L-x) \quad (3)$$

Accordingly, by setting the original scanning speed $v_1$ during the copying operation for the first sheet on the basis of the following equation (4), it is possible to correct the deviation (shrink amount) of the image in the sheet conveying direction:

$$v_1=\{(L-\Delta y)/L\}\times v_p \quad (4)$$

Further, during the supplying operation for the second sheet and so on, since the auxiliary supply by means of the friction rotary member 2 can be effected as mentioned above, the conveyance of the sheet by means of the regist rollers 13, 14 is not obstructed. Thus, the original scanning speed may be the same as the process speed $v_p$.

Regarding the sheets supplied from the sheet supply portion 28, a control method similar to that regarding the sheet supply portion 27 can be adopted. That is to say, when a distance from the transfer portion 41 and a nip between the friction rotary member 2' and the friction pad 3' is x', as is in the aforementioned case, the original scanning speed $v_1'$ for the first sheet can be determined by the following equation (5):

$$v_1'=\{(L-\Delta y)/L\}\times v_p \quad (5)$$

Further, in the above-mentioned embodiment, while an example that the stationary friction pad 3 urged against the friction rotary member is used as the sheet double-feed preventing means was explained, in place of the friction pad, a friction rotary member urged against the friction rotary member 2 and rotated in a direction opposite to that of the friction rotary member 2 may be used to achieve the same technical advantage. In addition, a cassette using a separation pawl 50 as shown in FIG. 5 can be applied to the present invention.

Incidentally, as the convey means, a regist pawl may be additionally disposed at an upstream side of the paired regist rollers so that the tip end of the sheet can abut against the regist pawl. In this case, the regist rollers are normally called as "convey rollers". Even when the number of the sheet supply portions is further increased, by setting the original scanning speed as mentioned above, the same advantage can be achieved.

On the other hand, as is in the first embodiment, it can be designed so that the information regarding the length of the sheet is kept to be stored in the memory 4 even when the power source is turned OFF. In this case, the auxiliary supply of the sheet can be effected on the basis of the information regarding the length of the sheet stored in the memory 4 immediately after the power source is turned ON again.

As mentioned above, according to the present invention, since the length detection means for detecting the supplied sheet, the memory means for storing the length of the sheet, and the sheet detection means for detecting presence/absence of the sheet, and since, when a first sheet is supplied, the length of the sheet is detected by the length detection means and the detected length of the sheet is stored in the memory means, and, when second, third, fourth sheets and so on are supplied, the sheet supply means is operated on the basis of information regarding the sheet length stored in the memory means to aid the conveyance of the sheet until the absence of the sheet is detected by the sheet detection means, the auxiliary conveyance in accordance with the length of the sheet can be achieved, with the result that the conveyance preventing force of the sheet supply means does not act on the convey means due to the auxiliary conveyance, thereby greatly suppressing the wear of the convey means. Further, it is possible to provide a sheet supply apparatus capable of detecting the length of the sheet with a simple construction which does not make the apparatus bulky.

Further, in the above-mentioned image forming apparatus comprising the above-mentioned sheet supply apparatus, the scan means for scanning the original, and the image forming mean for forming the image on the sheet, since the original scanning speed for the first sheet is changed from the original scanning speed for the second, third sheets and so on, the original scanning speed can be set to correct "shrink" or "contraction" of the image caused by the supply of the first sheet, and, regarding the first sheet, even if the conveyance preventing force of the sheet supply means acts on the convey means, the shrink amount of the image can be corrected.

Incidentally, in the above-mentioned embodiments, while an example that, after the conveyance of the sheet by means of the regist rollers 13, 14 is started, the stop timing of the friction rotary member 2 is set to be effected before the trailing end of the sheet passes through the nip between the friction rotary member 2 and the friction pad 3 was explained. The reason is that, if the friction rotary member is rotated even after the trailing end of the sheet passes through the nip, the next sheet is supplied. However, so long as a supplying amount of the sheet is small which is permissible, the stop timing of the friction rotary member may be set to be effected after the trailing end of the sheet passes through the nip.

In the above-mentioned embodiments, while an example that the sheet supply means comprises the friction rotary member 2 contacting with the sheet stack 11 and with the friction pad 3 was explained, the present invention is not limited to such an example.

For example, the sheet supply means may comprise a first rotary member for feeding out the sheet while contacting with the sheet stack 11, a second rotary member disposed adjacent to and at a downstream side of the first rotary member and rotated in the same direction as the first rotary member, and a friction member for cooperating with the second rotary member to pinch the sheet therebetween, thereby preventing the advancing movements of the second, third sheets and so on. Further, the friction member for preventing the advancing movements of the second, third sheets and so on may be constituted by a roller rotated in the same direction as the first and second rotary members, thereby returning the second, third sheets and so on. In this case, after the regist rollers 13, 14 are rotated, the stop timing of the friction rotary member 2 may be set to be effected before or after the trailing end of the sheet passes through the nip between the second rotary member and the friction member.

Further, in place of the sheet supply means for supplying the sheet from the sheet stack, a convey means comprised of a pair of rollers for pinching a sheet fed from an upstream side and conveying the sheet toward a downstream side may be used. In this case, after the regist rollers 13, 14 are rotated, the stop timing of the convey means may be set to be effected before or after the trailing end of the sheet passes through a nip between the paired rollers.

What is claimed is:

1. A sheet supply apparatus comprising:

a sheet supply means for supplying a sheet one by one from a sheet stack;

a convey means for conveying the sheet supplied by said sheet supply means;

a detection means for detecting a length of the sheet supplied by said sheet supply means, in a sheet supplying direction;

a memory means for storing the length of the sheet detected by said detection means; and a control means for operating said sheet supply means after the sheet is conveyed by said convey means, on the basis of information regarding the length of the sheet stored in said memory means, wherein said control means stops said sheet supply means after the sheet supplied by said sheet supply means abuts against a nip of the stopped convey means to form a loop in the sheet, and operates said sheet supply means while the sheet is being conveyed by said convey means.

2. A sheet supply apparatus according to claim 1, wherein said control means operates said sheet supply means at least until a trailing end of the sheet passes through said sheet supply means, on the basis of the information regarding the length of the sheet stored in said memory means.

3. A sheet supply apparatus according to claim 2, wherein said control means operates said sheet supply means until immediately after the trailing end of the sheet passes through said sheet supply means, on the basis of the information regarding the length of the sheet stored in said memory means.

4. A sheet supply apparatus according to claim 1, wherein said control means operates said sheet supply means until immediately before a trailing end of the sheet passes through said sheet supply means, on the basis of the information regarding the length of the sheet stored in said memory means.

5. A sheet supply apparatus according to claim 1, wherein said sheet supply means has a rotary member contacting with an uppermost sheet among said sheet stack.

6. A sheet supply apparatus according to claim 1, wherein said detection means detects the length of the sheet being supplied.

7. A sheet supply apparatus according to claim 1, wherein said detection means measures a time period required for the sheet to pass through a predetermined position, and calculates the length of the sheet on the basis of said time period.

8. A sheet supply apparatus according to claim 1, wherein said memory means stores a length of a first sheet in the sheet supplying direction, and said control means operates said sheet supply means after a second sheet and so on is conveyed by said convey means, on the basis of information regarding the length of the first sheet stored in said memory means.

9. A sheet supply apparatus according to claim 1, wherein said memory means stores a length of a second sheet only when there is an absence of information regarding the length of the first sheet, and said control means operates said sheet supply means after a second sheet is conveyed by said convey means, on the basis of information regarding the length of the first sheet stored in said memory means.

10. A sheet supply apparatus according to claim 1, wherein, when said memory means is without information regarding the length of the sheet, information regarding the length of the sheet is supplied by said sheet supply means.

11. A sheet supply apparatus according to claim 10, wherein, when the information regarding the length of the sheet is not stored in said memory means, said control means stops said sheet supply means at a predetermined timing after a tip end of the sheet reaches said convey means.

12. A sheet supply apparatus according to claim 1, wherein said control means calculates a timing that a trailing end of the sheet passes through said sheet supply means on the basis of information regarding the length of the sheet stored in said memory means, and stops said sheet supply means in response to the calculated timing.

13. A sheet supply apparatus according to claim 1, wherein, when said sheet supply means is stopped after the loop is formed, said control means calculates a supplying amount of the sheet by said sheet supply means required for causing the sheet to pass through said sheet supply means, and operates said sheet supply means on the basis of the calculated supplying amount.

14. A sheet supply apparatus according to claim 13, wherein said control means controls said sheet supply means in such a manner that said sheet supply means is stopped after the sheet supply of the calculated supplying amount, while the sheet is being conveyed by said convey means.

15. A sheet supply apparatus according to claim 1, wherein said control means varies a time period for effecting a sheet supplying operation of said sheet supply means on the basis of information regarding the length of the sheet stored in said memory means, after the sheet is conveyed by said convey means.

16. A sheet supply apparatus according to claim 1, wherein said control means varies a timing for stopping a sheet supplying operation of said sheet supply means on the basis of information regarding the length of the sheet stored in said memory means, after the sheet is conveyed by said convey means.

17. A sheet supply apparatus comprising:

a sheet supply means for supplying a sheet one by one from a sheet stack;

a convey means for conveying the sheet supplied by said sheet supply means;

a detection means for detecting a length of the sheet supplied by said sheet supply means, in a sheet supplying direction;

a memory means for storing the length of the sheet detected by said detection means; and a control means for operating said sheet supply means after the sheet is conveyed by said convey means, on the basis of information regarding the length of the sheet stored in said memory means, wherein said sheet supply means has a rotary member rotating and contacting with the sheet stack, and a separation member for preventing an advancing movement of sheets other than a sheet contacted with said rotary member.

18. A sheet supply apparatus according to claim 17, wherein said separation member has a friction member contacted with a surface of the sheet supplied by said rotary member opposite to a surface of the sheet contacted with said rotary member.

19. A sheet supply apparatus according to claim 18, wherein said friction member and said rotary member pinch the sheet therebetween.

20. A sheet supply apparatus according to claim 18, further comprising a second rotary member disposed at a downstream side of the first-mentioned rotary member and cooperating with said friction member to pinch the sheet therebetween, and wherein said second rotary member applies a conveying force to the sheet in a conveying direction, and said friction member applies a conveying force to the sheet in a direction opposite to said conveying direction due to rotation of said friction member.

21. A sheet supply apparatus according to claim 1, wherein, when there is no stacked sheet, information regarding the length of the sheet stored in said memory means is erased.

22. A sheet supply apparatus according to claim 1, further comprising an image forming means for forming an image on the sheet conveyed by said convey means.

23. A sheet supply apparatus comprising:

a first convey means for conveying a sheet;

a second convey means for conveying the sheet conveyed by said first convey means;

a detection means for detecting a length of the sheet conveyed by said first convey means, in a sheet supplying direction;

a memory means for storing the length of the sheet detected by said detection means; and a control means for varying a time period for operating said first convey means while the sheet is being conveyed by said second convey means, on the basis of information regarding the length of the sheet stored in said memory means.

24. A sheet supply apparatus comprising:

a first convey means for conveying a sheet;

a second convey means for conveying the sheet conveyed by said first convey means;

a detection means for detecting a length of the sheet conveyed by said first convey means, in a sheet supplying direction;

a memory means for storing the length of the sheet detected by said detection means; and a control means for changing a time period for operating said first convey means for a first sheet from a time period for operating said first convey means for a second sheet, on the basis of information regarding the length of the sheet stored in said memory means.

25. A sheet supply apparatus having a sheet supply means for supplying sheets one by one, comprising:

a first convey means for conveying a sheet;

a second convey means for conveying the sheet conveyed by said first convey means;

a detection means for detecting a length of the sheet conveyed by said first convey means, in a sheet supplying direction;

a memory means for storing the length of the sheet detected by said detection means; and a control means for changing a time period for operating said first convey means for a first sheet from a time period for operating said first convey means for a second sheet, on the basis of information regarding the length of the sheet stored in said memory means, wherein when a first sheet is supplied, the length of the sheet is detected by said length detection means and the detected length of the sheet is stored in the memory means, and, when second, third, fourth sheets and so on are supplied, said sheet supply means is operated on the basis of information regarding the sheet length stored in the memory means.

26. An image forming apparatus comprising:

a first convey means for conveying a sheet;

a second convey means for conveying the sheet conveyed by said first convey means;

a detection means for detecting a length of the sheet conveyed by said first convey means, in a sheet supplying direction;

a memory means for storing the length of the sheet detected by said detection means;

a control means for changing a time period for operating said first convey means for a first sheet from a time period for operating said first convey means for a second sheet, on the basis of information regarding the length of the sheet stored in said memory means; and an image forming means for forming an image on the sheet supplied by said sheet supply apparatus, wherein when a first sheet is supplied, the length of the sheet is detected by said length detection means and the detected length of the sheet is stored in the memory means, and, when second, third, fourth sheets and so on are supplied, said sheet supply means is operated on the basis of information regarding the sheet length stored in the memory means.

27. An image forming apparatus having a sheet supply apparatus including a sheet supply means for supplying sheets one by one, a scan means for scanning an original, and an image forming means for forming an image on the sheet supplied by said sheet supply apparatus, comprising:

a first convey means for conveying a sheet;

a second convey means for conveying the sheet conveyed by said first convey means;

a detection means for detecting a length of the sheet conveyed by said first convey means, in a sheet supplying direction;

a memory means for storing the length of the sheet detected by said detection means; and a control means for changing a time period for operating said first convey means for a first sheet from a time period for operating said first convey means for a second sheet, on the basis of information regarding the length of the sheet stored in said memory means, wherein when a first sheet is supplied, the length of the sheet is detected by said length detection means and the detected length of the sheet is stored in the memory means, and, when second, third, fourth sheets and so on are supplied, said sheet supply means is operated on the basis of information regarding the sheet length stored in the memory means, and wherein an original scanning speed of said scan means for the first sheet is changed from that for the second, third, fourth sheets and so on.

28. A sheet supply apparatus comprising:

a containing means for containing at least one sheet;

a presence/absence detection means for detecting presence/absence of the sheet in said containing means;

a first convey means for conveying a sheet;

a second convey means for conveying the sheet conveyed by said first convey means;

a detection means for detecting a length of the sheet conveyed by said first convey means, in a sheet supplying direction;

a memory means for storing the length of the sheet detected by said detection means; and a control means for changing a time period for operating said first convey means for a first sheet from a time period for operating said first convey means for a second sheet, on the basis of information regarding the length of the sheet stored in said memory means.

* * * * *

UNITED STATES PATENT AND TRADEMARK OFFICE

CERTIFICATE OF CORRECTION

PATENT NO. : 5,678,127
DATED : October 14, 1997
INVENTOR(S) : Takeshi SUGA

Figure 3:
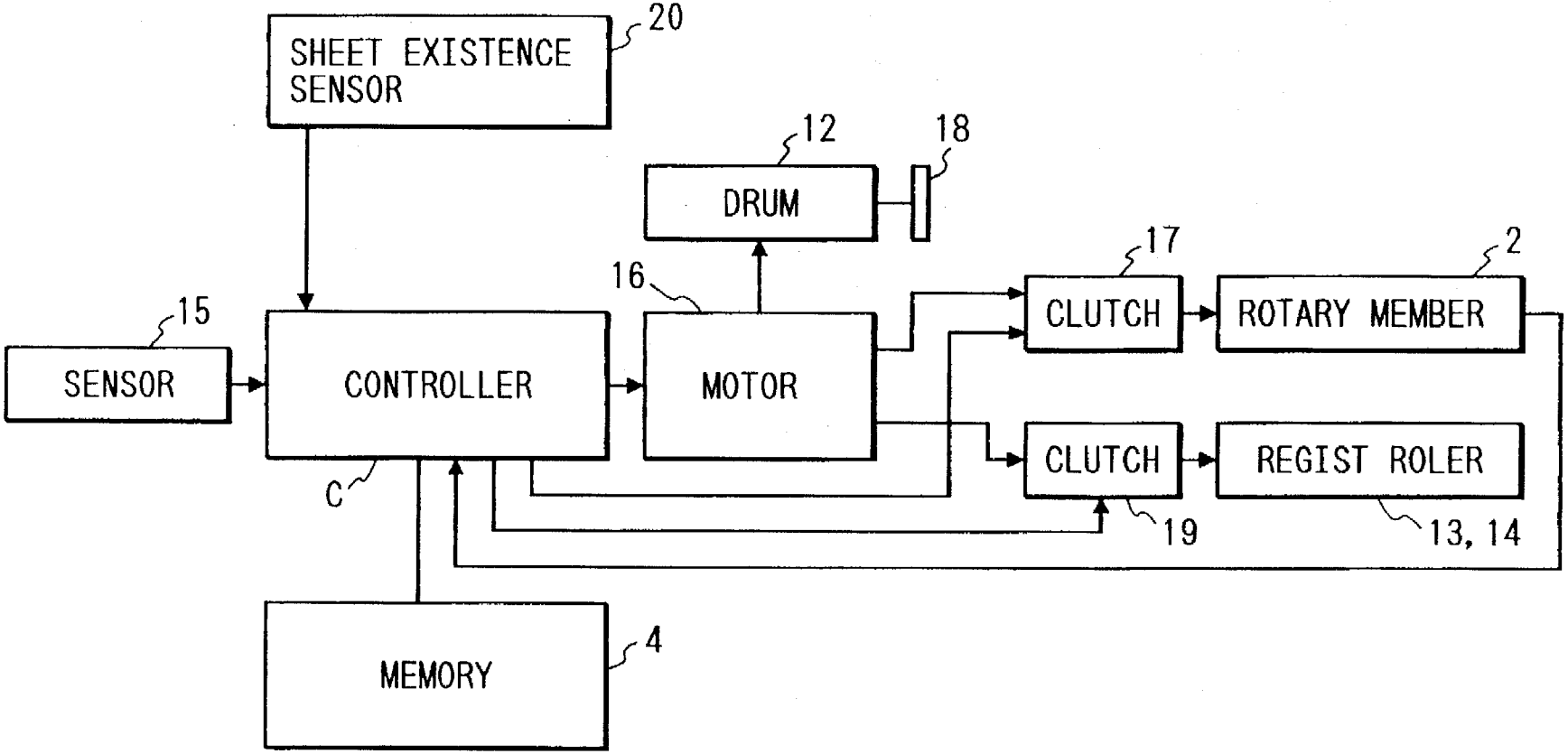
FIG. 3 is a control block diagram of the sheet supply apparatus of FIG. 1.

It is certified that error appears in the above-identified patent and that said Letters Patent is hereby corrected as shown below:

Figure 3, delete "ROLER" and insert therefor --ROLLER--.

Figure 8, delete "ROLER" and insert therefor --ROLLER--.

Column 1, line 40, delete "synchronous" and insert therefor --synchronism--.

Column 4, line 54, delete "transmits" and insert therefor --transmit--;
Line 67, delete "synchronous" and insert therefor --synchronism--.

Column 8, line 57, delete "is disappeared" and insert therefor --disappears--.

Column 12, line 4, delete "and so on".

Signed and Sealed this

Twenty-eighth Day of April, 1998

Bruce Lehman

*Attest:*

BRUCE LEHMAN

*Attesting Officer*

*Commissioner of Patents and Trademarks*